US005694854A

United States Patent [19]

Becker

[11] Patent Number: 5,694,854

[45] Date of Patent: Dec. 9, 1997

[54] DEVICE FOR STRETCHING THE REAR EDGE OF A PRINTING PLATE IN THE PLATE CYLINDER OF ROTARY PRINTING PRESSES

[75] Inventor: Willi Becker, Bammental, Germany

[73] Assignee: Heidelberger Druckmaschinen Aktiengesellschaft, Heidelberg, Germany

[21] Appl. No.: 638,480

[22] Filed: Apr. 26, 1996

[30] Foreign Application Priority Data

Apr. 29, 1995 [DE] Germany ..... 195 15 845.8

[51] Int. Cl.[6] ..... B41F 1/28

[52] U.S. Cl. ..... 101/415.1; 101/378

[58] Field of Search ..... 101/378, 382.1, 101/383, 415.1, DIG. 36

[56] References Cited

U.S. PATENT DOCUMENTS 5,367,954 11/1994 Becker ..... 101/415.1
5,379,694 1/1995 Idaek et al. ..... 101/415.1
5,383,401 1/1995 Brotzman ..... 101/415.1
5,440,984 8/1995 Becker ..... 101/415.1
5,488,904 2/1996 Kleinschmidt et al. ..... 101/415.1

FOREIGN PATENT DOCUMENTS 4244279 6/1994 Germany .

*Primary Examiner*—Ren Yan
*Attorney, Agent, or Firm*—Nils H. Ljungman and Associates

[57] ABSTRACT

A device for stretching the rear edge of a printing plate in the plate cylinder of a rotary printing press. An extension shaft is provided in a channel which extends in the longitudinal direction of the plate cylinder, whereby fastened to the extension shaft are stretching elements which interact with retaining elements and make possible a stretching of the printing plate. Adjustment means are provided on both sides of the extension shaft, which adjustment means are supported on the cylinder cheeks and make possible an extension of the printing plate in the axial direction. The device makes possible, in addition to the extension of the rear edge of the printing plate, a lateral offset by a small amount.

20 Claims, 4 Drawing Sheets

DEVICE FOR STRETCHING THE REAR EDGE OF A PRINTING PLATE IN THE PLATE CYLINDER OF ROTARY PRINTING PRESSES

BACKGROUND OF THE INVENTION

1. Field of the Invention

The present invention generally relates to a device for stretching the rear edge of a printing plate in the plate cylinder of a rotary printing machine. The device has an extension shaft which is provided in a channel which extends in the longitudinal direction of the plate cylinder. Fastened to the extension shaft are stretching elements which interact with retaining elements and make it possible to stretch the printing plate. On both sides of the extension shaft are adjustment means which are supported on the cylinder cheeks and make it possible to stretch the printing plate in the axial direction of the shaft. The extension shaft is mounted so that it can rotate in a support bearing, and is guided axially by means of axial bearings on both sides of the support bearing.

2. Background Information

German Patent No. 42 44 279 A1, which corresponds to U.S. Pat. No. 5,367,954, shows such a device. The device compensates for the stretching of a printing plate, wherein a printing plate can be adjusted to changes in the printed image because of stretching of the printing plate being processed. The rear edge of the printing plate, viewed in the axial direction, can be expanded outward toward both sides from a support bearing which is located in the middle. In the known device it was also possible to expand only one side or the other, so that for an application of ink to one side of the plate cylinder, it is possible to make a suitable expansion of the rear edge of the plate.

OBJECT OF THE INVENTION

The object of the invention is to create a stretching device for the rear edge of a printing plate, in which the extension of the rear edge of the printing plate can also be adapted to printing plates which, in their rear area, are not only circumferentially extended, but are also offset laterally by a small amount. This can occur, for example, if a printed sheet is provided with a printed image only on one side, so that the entire sheet is not only extended, but is also laterally offset on its rear edge.

SUMMARY OF THE INVENTION

The present invention teaches that this object can be accomplished if the guidance of the extension shaft in the support bearing is realized so that it is axially adjustable. As soon as a printed sheet is laterally offset on its rear edge, the invention gives the printer the opportunity to apply a higher tensile force on one side of the extension shaft by means of the corresponding adjustment mechanism, so that the extension shaft is axially adjusted in its entire length by a small amount with respect to the support bearing. The printing plate is thereby displaced axially, so that it can be adjusted to the printed image on the printed sheet. Independently, however, the rear edge of the printing plate can be extended as a function of specific requirements, so that an optimal adjustment of the rear edge of the plate can be made.

In other words, tensioning means is provided by introducing an axial force to the extension shaft at or near the support bearing. This results in a non-uniform tensile force in the extension shaft and an axial displacement of the extension shaft relative to the support bearing.

If an adjusting mechanism on the ends of the extension shaft can induce tensile strain at each end of the shaft (e.g. by an adjusting nut threaded on each end of the extension shaft), the printer may first apply equal tensile strains on each end of the extension shaft. The equal tensile strains can generate a uniform tensile force in the extension shaft, with progressive cumulative stretching of the extension shaft from its center outwards.

If the printer then proceeds to apply additional tensile strain to only one end of the shaft, more tensile strain exists on that end of the shaft than exists on the other end. Because the tensile strains at each end of the extension shaft are no longer equal in magnitude, the additional strain can cause an axial displacement of the center of the extension shaft towards the side with the greater tensile strain.

By having the axial displacement of the shaft compress a spring acting between the shaft and support bearing, again a non-uniform tensile force in the extension shaft can be created. The spring deformation causes a biasing force to be exerted against axial deformation of the extension shaft. If the tensile strains are again equalized, the biasing force can aid in returning the shaft to its centered position.

The axial adjustment of the extension shaft can be realized substantially independently of the ability of the extension shaft to rotate. Axial bearings could be used as bearing surfaces to apply axial forces to the extension shaft. The axial bearings allow axial loads to be applied to the extension shaft without high friction that could prevent rotation of the extension shaft. Therefore the rear edge of the printing plate can be clamped and circumferentially stretched by rotation of the extension shaft while also being laterally offset, so that optimal adjustment of the rear edge of the printing plate can be achieved.

In one advantageous embodiment of the invention, there is a threaded bushing in the support bearing. The support bearing can support axial bearings. The threaded bushing can be set to bear against one of the axial bearings without clearance by means of adjusting screws in the support bearing. The printer can precisely adjust the lateral offset of the rear edge of the plate by means of the threaded bushing, and then circumferentially stretch the rear edge of the printing plate in the customary manner.

By rotating the threaded bushing, an axial force is applied to the axial bearing. The axial bearing transmits an axial force to the extension shaft. In one possible embodiment, the axial bearing bears against a clamping element axially fixed to the extension shaft. The clamping element thereby causes the printing plate to stretch axially in response to the applied force. However, the clamping element is free to rotate with the extension shaft to circumferentially stretch the clamped portion of the printing plate.

An additional embodiment of the invention is characterized by the fact that there is a plate spring on each side of the support bearing between the support bearing and the axial bearing. Different loads can be applied to the plate springs by means of an adjustment mechanism. The printer can thereby effect an axial displacement of the extension shaft by means of the adjustment means against the force of a plate spring, so that the extension shaft can be axially displaced within the range of the spring travel. The displacement generally could be a matter of a few tenths of a millimeter. As soon as the printer releases the adjustment means, the plate springs move the extension shaft back to the original position of the shaft prior to application of the adjustment means.

In other words, the adjustment means imparts an axial displacement of the extension shaft in the vicinity of the support bearing. The axial displacement of the extension shaft is transmitted by an axial bearing to a plate spring located against the support bearing. Deformation of the plate spring generates a biasing force opposing the axial displacement of the extension shaft. As soon as the printer releases the adjustment means, the biasing force aids to move the extension shaft back to the original position of the shaft prior to application of the adjustment means.

The same effect can also be achieved by realizing the support bearing so that it is elastic, and can be deflected from the zero position by means of the adjustment mechanism. The flexible realization can be provided by means of a thinner area on the support bearing, whereby as a result of the elasticity of the support bearing, the release of the adjustment means in turn causes a return to the original position of the shaft prior to application of the adjustment means. Flexibility can also be provided by the mounting of the support bearing, e.g. also on plate springs.

The invention could be viewed as a means to introduce an axial strain or displacement to at least one portion of the extension shaft. The extension shaft is in effect divided into two shaft portions, with at least one shaft portion changing length to effect an axial offset along the shaft. In the embodiments described above, the extension shaft can have a non-uniform axial force acting along its length, with one axial force acting in one shaft portion and a differing axial force which could act in the remaining second shaft portion. In one embodiment, the non-uniform axial force may be caused by a threaded bushing imparting an axial force to the shaft via bearing against a clamping element located along the shaft. In another embodiment, the non-uniform axial force may be generated by the reaction force of a plate spring acting on the shaft.

One aspect of this invention resides broadly in a device for tensioning a printing plate on a plate cylinder of a printing press, the plate cylinder having a first axial end and a second axial end positioned opposite the first axial end, the plate cylinder defining an axial axis between the first and second axial ends of the plate cylinder, the plate cylinder having an axially oriented recess therein for at least partially accommodating the device, the tensioning device including: clamping apparatus, for clamping the end of a printing plate to a plate cylinder; the clamping apparatus including a shaft at least partially located within the recess; the shaft having a longitudinal axis; the shaft including a first shaft portion and a second shaft portion; the first shaft portion having a length, which length includes a substantial portion of the shaft; the second shaft portion having a length, which length includes a substantial portion of the shaft; an apparatus for mounting the shaft at least partially within the recess; and an apparatus for changing the length of the first shaft portion.

Another aspect of this invention resides broadly in a device for tensioning a printing plate on a plate cylinder of a printing press, whereby the apparatus for changing the length of the first shaft portion includes an apparatus for applying a force to the first shaft portion; which apparatus to apply force to the first shaft portion includes a tensioning element mounted on the second portion of the shaft immediately adjacent to the first shaft portion, the tensioning element being part of the clamping apparatus, and also includes a base for supporting the shaft, the base being attached to the plate cylinder; the base including a threaded hole to engage a threaded bushing, the threaded bushing carrying a bearing in a hole to support the shaft; which threaded bushing can rotate in the threaded hole to bear against an axial bearing mounted on the shaft between the threaded bushing and the tensioning element.

Yet another aspect of this invention resides broadly in a device for tensioning a printing plate on a plate cylinder of a printing press, whereby the apparatus for changing the length of the first shaft portion includes an apparatus to apply a biasing force to return the shaft to its original position prior to changing the length of the first shaft portion.

An additional aspect of this invention resides broadly in a device for tensioning a printing plate on a plate cylinder of a printing press, whereby the apparatus for changing the length of the first shaft portion includes an apparatus for applying a force to the first shaft portion; the apparatus for applying a force to the first shaft portion includes an apparatus to apply a biasing force to return the shaft to its original position prior to changing the length of the first shaft portion, whereby the apparatus to apply a biasing force includes a plate spring mounted on the first shaft portion between a support bearing and a biasing element mounted on the second shaft portion immediately adjacent to the first shaft portion, which biasing element is a component of the clamping apparatus.

A further aspect of this invention resides broadly in a device for tensioning a printing plate on a plate cylinder of a printing press, whereby the apparatus for changing the length of the first shaft portion includes an apparatus to apply a biasing force to return the shaft to its original position prior to changing the length of the first shaft portion, the apparatus to apply a biasing force including a flexible construction of a support bearing.

When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present invention is explained in greater detail below with reference to the accompanying drawings, in which.

DESCRIPTION OF THE PREFERRED EMBODIMENT

Figure 1:
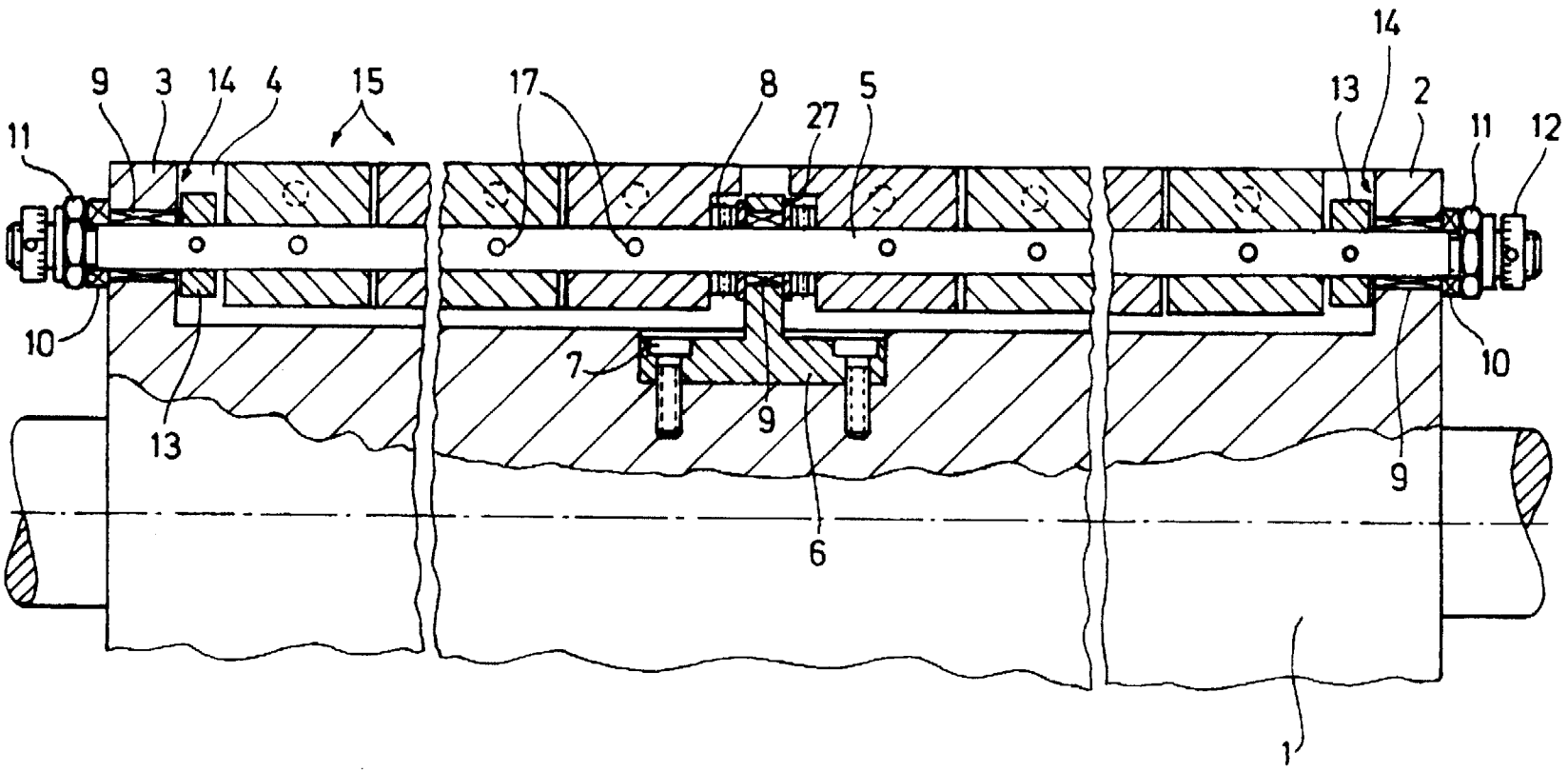
FIG. 1 shows a longitudinal section through the channel of a plate cylinder with the extension shaft.

FIG. 1 illustrates one possible embodiment of the invention. On a plate cylinder 1 having two axial end surfaces there are preferably cylinder cheeks 2 and 3, each of which locates a radial bearing 9. In the radial bearing 9 there is an extension shaft 5 which extends through a channel 4 in the longitudinal direction of the plate cylinder 1. The extension shaft 5 preferably is supported centrally by means of a support bearing 6 which is fastened to the plate cylinder 1 by means of retaining screws 7. In the support bearing 6 there can be a radial bearing 9 which guides the extension shaft 5 radially. The extension shaft 5 is also supported on the support bearing 6 by means of axial bearings 8 on both sides.

On the extension shaft 5, on both sides of the support bearing 6, there preferably are individual stretching elements 15, which are fixed in their position by means of retaining bolts 17 on the extension shaft 5. On the ends of the extension shaft 5, in the vicinity of the cylinder cheeks 2 and 3, on their inside, extension limiter rings 13 can be fastened to the extension shaft 5. On the outside of the cylinder cheeks 2 and 3, threaded segments are preferably realized on each end of the extension shaft 5, to which an adjustment element 11, e.g. an element realized in the form of an adjusting nut, is movably fastened. There can be a scaling 12 corresponding to both adjusting elements 11. The scaling 12 makes it possible to read the adjustment distance. To reduce the head friction between the outside surfaces of the cylinder cheeks 2 and 3 and the outside surfaces of the adjusting elements 11, there can be axial bearings 10 between the cylinder cheeks 2 and 3 and the adjustment element 11. There is preferably an air gap 14 of several tenths of a millimeter between the extension limiting rings 13 and the insides of the cylinder cheeks 2 and 3.

In accordance with an embodiment, if an end 16 of the printing plate 18 (see FIG. 2) which is in the stretched position on the plate cylinder 1 is to be adapted to the dimension of a plate cylinder 1 in the axial direction, the printer moves the adjustment elements 11 respectively toward the cylinder cheeks 2 and 3. The axial bearings 10 are thereby in contact against the outer sides of the cylinder cheeks 2 and 3, whereupon the extension shaft 5 is placed under tension on both sides. The axial bearings 8 provided on the support bearing 6 are in clearance-free contact, so that when the tension is increased by rotating the adjustment elements 11, there is a displacement of the stretching elements 15 outward toward the cylinder cheeks 2 and 3. Since, when tension is applied to the extension shaft 5, the distances travelled by the individual stretching elements 15 increase progressively from the inside toward the outside, the respective outermost stretching elements 15 move the greatest distance. The result is a progressive extension of the extension shaft 5 essentially linearly on both sides from inside to outside, and therefore, since the individual stretching elements 15 are fastened to it, a linear displacement of the individual stretching elements 15 which increases from inside to outside. As a result of the displacement of the individual stretching elements 15, there can be a correction of the position of the end 16 of the printing plate 18 when it is stretched in place. The printer is thereby able to adjust the printing plate 18 to the dimension of the plate cylinder 1 in the axial direction. The extension limiter rings 13 thereby essentially prevent an overloading of the extension shaft 5.

Moving adjustment elements 11 toward the cylinder cheeks 2 and 3 introduce tensile strains at each end of the extension shaft 5. If the adjusting elements 11 are adjusted in equal amounts, the tensile strains at each end of the extension shaft 5 are equal. The extension limiter rings 13 prevent the tensile strains from exceeding the elastic limit of the extension shaft 5. Assuming the extension shaft 5 is elastic with a substantially constant elasticity throughout, there will be a uniform tensile stress in the extension shaft 5, with progressive cumulative stretching of the extension shaft 5 from the central support bearing 6 outwards towards each of adjustment elements 11.

Figure 2:
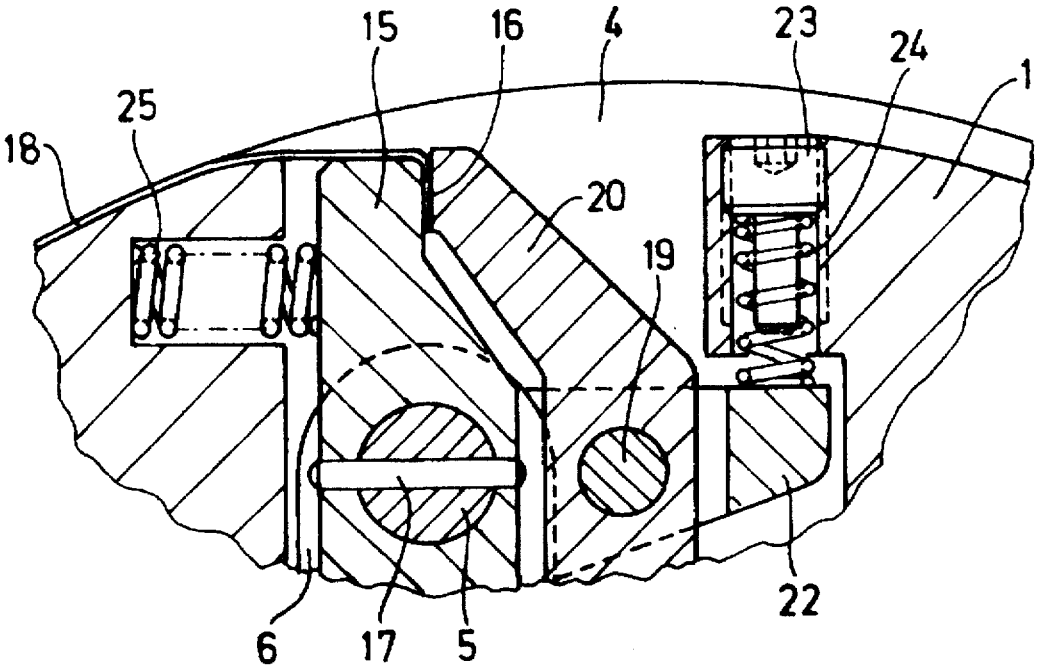
FIG. 2 shows a cross section through the channel and through a stretching element for the printing plate.

In accordance with an embodiment of the present invention, FIG. 2 shows a partial cross section through the plate cylinder 1 with the channel 4, in which the extension shaft 5 is provided in turn. The stretching elements 15 are fastened to the extension shaft 5 by means of retaining bolts 17. Corresponding to each stretching element 15 there is a stretching lever 20 which stretches the end of the printing plate 18 to the stretching elements 15. By rotating clockwise, the printing plate 18 can be clamped fast to the plate cylinder 1 by means of the stretching elements 15. The stretching levers 20 are thereby preferably mounted on bolts 19 which in turn are fastened in a lever extension 22. The end 16 of the printing plate 18 is thereby stretched by means of the springs 24 and 25, whereby the spring force can be adjusted, for example, by means of an adjusting screw 23 to meet suitable requirements.

Figure 3:
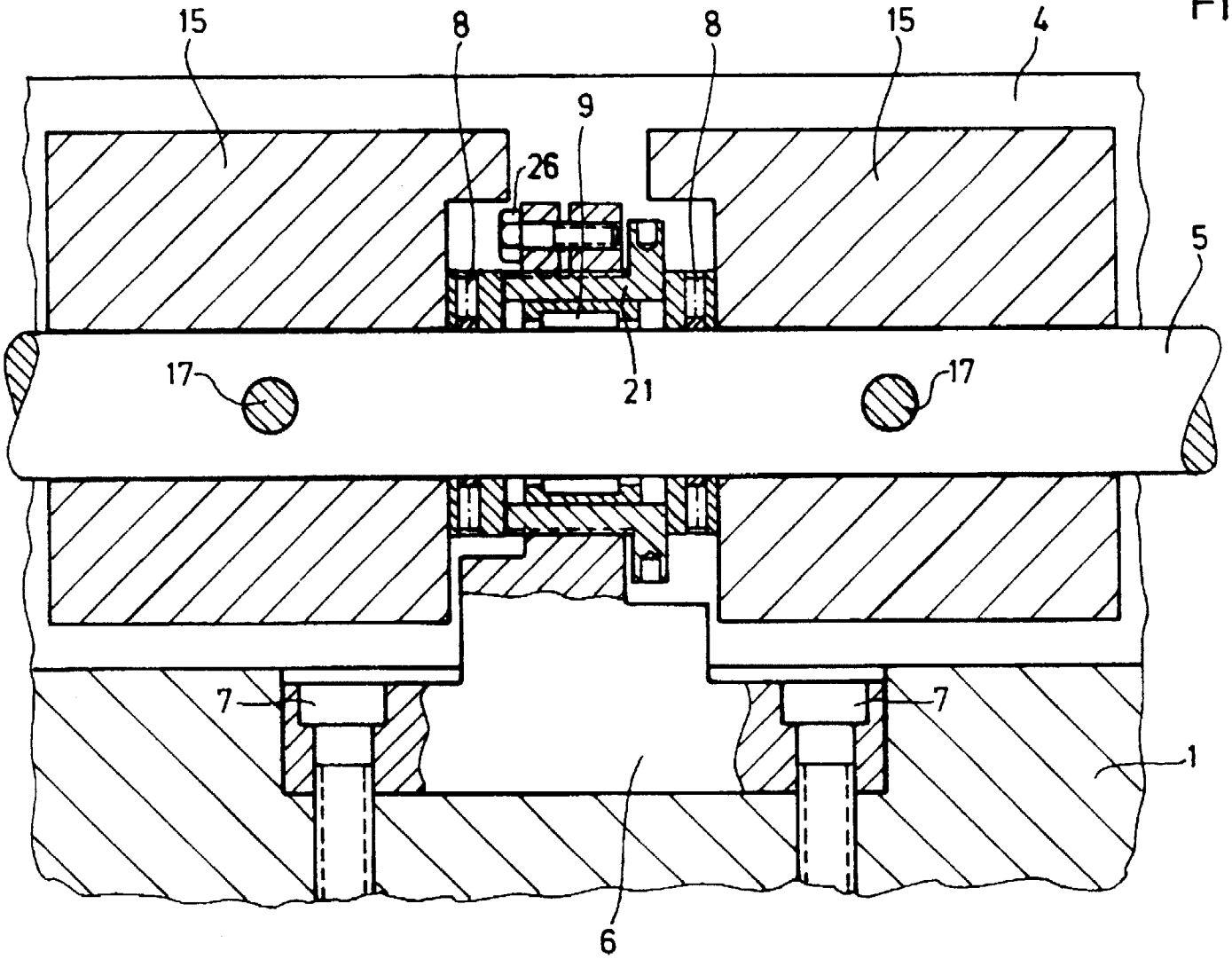
FIG. 3 shows a partial longitudinal section through the extension shaft with threaded bush.

FIG. 3 shows an embodiment of the present invention which includes the mounting of the extension shaft 5 in a threaded bushing 21 by means of a radial bearing 9. The threaded bushing 21 is in contact without clearance by means of axial bearings 8 against the stretching elements 15, which are connected by means of retaining bolts 17 to the extension shaft 5. By rotating the threaded bushing 21, in the threaded portion of the support bearing 6, the extension shaft 5 can be displaced axially. The threaded bushing 21 can be set without clearance, e.g. by means of an adjusting screw 26 in the support bearing 6, so that the lateral displacement of the extension shaft 5 can be carried out with great precision.

By rotating the threaded bushing 21 in the threaded portion of the support bearing 6, the threaded bushing 21 will attempt to translate axially with respect to the extension shaft 5. Axial displacement of the threaded bushing 21 is resisted by the axial bearing 8 in contact with the threaded bushing 21. The axial bearing 8 can be mounted on the extension shaft 5 to abut the threaded bushing 21. Rotation of the threaded bushing 21 against the axial bearing 8 preferably imparts an axial force against the axial bearing 8 that is transmitted to the extension shaft 5 via the stretching elements 15, and can thereby laterally offset the rear edge of the printing plate 18 with respect to the support bearing 6. By having an axial bearing 8 mounted on each side of the threaded bushing 21, the printer can offset the rear edge of the printing plate 18 with respect to the support bearing 6 towards either end of the extension shaft 5.

Figure 4:
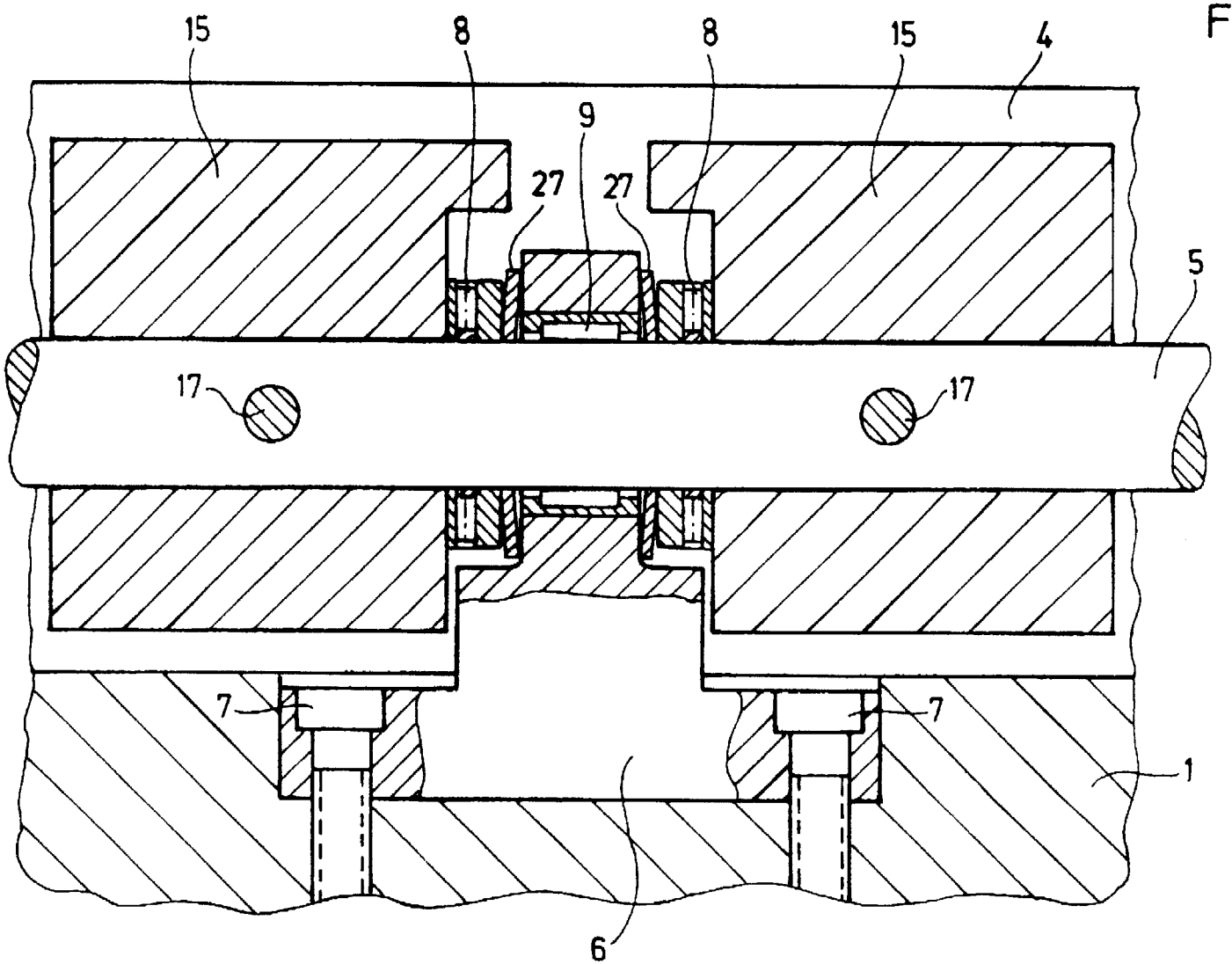
FIG. 4 shows a partial longitudinal section through the extension shaft with plate springs.

FIG. 4 illustrates one embodiment of the invention in which the extension shaft 5 is supported in the axial direction by means of the stretching elements 15, and the axial bearings 8 on both sides of the support bearing 6 by means of plate springs 27. The printer is thereby able, by applying more tension to an adjustment element 11 on one side of the plate cylinder 1, to apply a greater load to one plate spring 27, so that the extension shaft 5 is displaced by a small amount toward this side. Consequently, or as a result of a flexible realization of the support bearing 6, the adjustment means 11 can be used to move the extension shaft 5 axially relative to the support bearing 6, thereby making possible a simple lateral adjustment of the printing plate 18.

To further explain, by applying more tension to an adjustment element 11 on one side of the plate cylinder 1 than to the other adjustment element 11, more tensile strain is induced in the extension shaft 5 on the more highly tensioned side than is induced on the other side. Because the induced tensile strains at each end of the extension shaft 5 are not equal in magnitude but are opposite in direction, there will be an axial displacement of the extension shaft 5 at the central support bearing 6. The axial displacement will be towards the end of the tension shaft 5 with the greater induced tensile strain, i.e., towards the more highly tensioned adjustment element 11.

Axial displacement of the extension shaft 5 at the central support bearing 6 can cause the clamping elements 15 to contact and compress the plate spring 27 located opposite the central support bearing 6 from the more highly tensioned adjustment element 11. Compression of the plate spring 27 preferably generates an axial biasing force opposing the axial displacement of the extension shaft 5. As soon as the printer relieves the excess tension on the adjustment means 11, the biasing force applied by the deformed plate spring 27 to the clamping elements 15 will aid to displace the extension shaft 5 back to the original axial position of the extension shaft 5 prior to application of the more highly tensioned adjustment element 11.

Other spring arrangements can be used in at least one embodiment, to generate a biasing force acting opposite axial displacement of the extension shaft 5. For example, the central support bearing 6 could incorporate resilience between the portion of the central support bearing 6 carrying radial bearing 9 and the attachment means (for example, retaining screws 7). Axial displacement of the extension shaft 5 at the central support bearing 6 could cause an axial force to be applied to the radial bearing support means, thereby generating resilient deflection of the central support base and a corresponding biasing force. The resilience could be provided by one or more discrete springs, or could result from a thinner cross-sectional area of the support bearing itself.

One feature of the invention resides broadly in the device for stretching the rear edge of a printing plate in the plate cylinder of rotary printing machines with an extension shaft which is provided in a channel which extends in the longitudinal direction of the plate cylinder, whereby fastened to the extension shaft are stretching elements which interact with retaining elements and make possible a stretching of the printing plate, and adjustment means are provided on both sides of the extension shaft, which adjustment means are supported on the cylinder cheeks and make possible an extension of the printing plate in the axial direction, whereby the extension shaft is rotationally mounted in the center of the cylinder in a support bearing, and is guided axially by means of axial bearings on both sides of the support bearing, characterized by the fact that the guidance of the extension shaft 5 in the support bearing 6 is axially adjustable.

Another feature of the invention resides broadly in the device characterized by the fact, that in the support bearing 6, there is a threaded bushing 21, on which the axial bearings 8 are supported, and that the threaded bushing 21, after the adjustment by means of an adjusting screw 26, can be set in the support bearing 6 so that there is no clearance.

Yet another feature of the invention resides broadly in the device characterized by the fact that between the support bearing 6 and the axial bearing 8, there is a plate spring 27 on each side of the support bearing 6, and different loads can be applied to the plate springs 27 by means of adjustment means 11.

Still another feature of the invention resides broadly in the device characterized by the fact that the support bearing 6 is realized in a flexible manner, and can be deflected from the zero position by means of the adjustment means 11.

It should be understood there are a variety of clamping and tensioning arrangements which could possibly be adapted for use in the present invention. Examples are included for illustrative purposes and are not meant to limit the application of the disclosed invention. Rather than having the axial force transmitted from the bearing support 6 to the extension shaft 5 by means of fixed tensioning elements 15, the extension shaft 5 could include a shoulder for receiving the axial force. Or the clamping and tensioning means could be arranged differently than the embodiment herein shown; spacer rings could be fixed to the extension shaft 5 to receive the axial force without involving any specific clamping or tensioning elements. Further, multiple bearing supports 6 could be employed, each bearing support 6 including its own separate means for applying axial force or biasing force to the extension shaft 5.

Further, it should be understood there are other methods of introducing an axial displacement of the tension shaft 5 relative to bearing support 6. Examples are included for illustrative purposes and are not meant to limit the application of the disclosed invention. The extension shaft 5 or a portion thereof could be heated or cooled, resulting in thermal expansion or contraction. Thermoelectric or electromagnetic means could be applied to the extension shaft 5 or a portion thereof to cause relative axial displacement. Or the extension shaft 5 could be made of two or more axial components, with hydraulic or pneumatic means of displacing one portion of extension shaft 5 relative to another portion.

Some examples of rotary printing presses which could possibly be adapted for use of the present invention might be disclosed by the following U.S. Patents 5,469,787 to Turner and Miller, entitled "Multi-color Printing Press"; U.S. Pat. No. 5,337,664 to Hannon, entitled "Printing Press with Blanket Cylinder Throw Off Apparatus and Method"; U.S. Pat. No. 5,355,798 to Yoder, Jr., entitled "Intermittent Motion Rotary Printing Press"; U.S. Pat. No. 5,178,898 to Sun, entitled "Printer with Roller Mounting Assembly"; U.S. Pat. No. 4,362,098 to Stelling, Jr., et al., entitled "Rotary Printing Press Using Flexible Plates"; and U.S. Pat. No. 4,301,728 to Jaffe, et al., entitled "Rotary Printing Press with a Bumping Mechanism".

Some examples of clamping arrangements and register adjustment apparatus which could possibly be adapted for use in the present invention, along with additional components generally associated with clamping mechanisms and register adjustment apparatus which might be interchangeable with, or adaptable as, components of the embodiments as described hereinabove, might be disclosed by the following U.S. Patents, all of which are assigned to Heidelberger Druckmaschinen Aktiengesellschaft, the assignee for the present invention: U.S. Pat. No. 4,785,736 to Jeschke, entitled "Device for Tensioning a Flexible Printing Plate Mounted on a Plate Cylinder"; U.S. Pat. No. 4,831,931 to Jeschke and Stadtler, entitled "Device for Tensioning a Flexible Printing Plate on a Plate Cylinder of a Rotary Printing Machine"; U.S. Pat. No. 5,014,619 to Jeschke, entitled "Device for Tensioning a Flexible Printing Plate on a Plate Cylinder of a Rotary Printing Machine"; U.S. Pat. No. 5,088,409 to Roskosch, entitled "Device for Adjusting a Flexible Printing Plate on a Plate Cylinder of a Rotary Printing Press"; U.S. Pat. No. 5,367,954 to Becker, entitled "Printing-Form Correction Device Compensating for the Stretching of Print Carriers"; U.S. Pat. No. 5,415,096 to Koch and Vogt, entitled "Device for Correcting Trapezoidal Register Deviations"; U.S. Pat. No. 5,415,097 to Junghans, entitled "Device for Transmitting Tensioning Forces to Printing-Unit Cylinders"; U.S. Pat. No. 5,419,248 to Brotzman, entitled "Adjustable Alignment Device for Printing Plates"; U.S. Pat. No. 5,423,258 to Weber, entitled "Clamping Device for Fastening a Flexible Printing Form on a Jacket Surface of a Cylinder"; U.S. Pat. No. 5,440,984 to Becker, entitled "Device for Clamping Flexible Printing Plates on the Plate Cylinder of Rotary Printing Presses"; and U.S. Pat. No. 5,488,904 to Kleinschmidt, et al., entitled "Device for Pivotally Adjusting Flexible Printing Plates on the Plate Cylinder of a Rotary Printing Machine".

Some additional examples of accessories which could possibly be used in the context of the present invention might be disclosed by the following U.S. Patents: U.S. Pat. No. 5,199,352 to Sugiyama, et al. entitled "Plate Lock-up Device for Printing Press"; U.S. Pat. No. 5,259,310 to Fischer entitled "Circumferential Register Adjusting Assembly"; U.S. Pat. No. 5,259,314 to Sugiyama entitled "Plate Mounting Apparatus for Printing Press"; U.S. Pat. No. 5,337,486 to Brechtel, entitled "Mechanism for Adjusting the Skew Angle of Inclination of a Prionting Plate on its Plate Cylinder"; and U.S. Pat. No. 5,398,609 to Stiel, entitled "Device for Tensioning and Adjusting Flexible Printing Plates on Plate Cylinders of Printing Presses".

Further additional examples of accessories which could possibly be used in the context of the present invention might be disclosed by the following Federal Republic of Germany Patent Application No. 195 15 843.1, filed on Apr. 29, 1995, having inventor Willi Becker, and DE-OS 195 15 843.1 and DE-PS 195 15 843.1, as well as their published equivalents.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 195 15 845.8, filed on Apr. 29, 1995, having inventor Willi Becker, and DE-OS 195 15 845.8 and DE-PS 195 15 845.8 as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant s option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

PARTIAL NOMENCLATURE

1 Plate cylinder
2 Cylinder cheek
3 Cylinder cheek
4 Channel
5 Extension shaft
6 Support bearing
7 Retaining screw
8 Axial bearing
9 Radial bearing
10 Axial bearing
11 Adjustment element
12 Scaling
13 Extension limiter ring
14 Gap
15 Stretching element
16 Printing plate end
17 Retaining bolts
18 Printing plate
19 Bolts
20 Stretching lever
21 Threaded bush
22 Lever extension
23 Adjusting screw
24 Spring
25 Stretching spring
26 Adjusting screw
27 Plate spring

What is claimed is:

1. A device for tensioning a printing plate on a plate cylinder of a rotary printing press, which plate cylinder has a first axial end, and a second axial end disposed opposite to said first axial end, which plate cylinder defines an axial axis between the first and second axial ends thereof, which plate cylinder has an axially disposed recess therein for at least partially accommodating said device, said device comprising:

retaining apparatus for retaining the end of a printing plate to a plate cylinder;

said retaining apparatus comprising a shaft for being at least partially disposed in the recess;

said shaft having a longitudinal axis;

said shaft comprising a first shaft portion and a second shaft portion;

said first shaft portion comprising a substantial portion of said shaft;

said first shaft portion having a length;

said second shaft portion comprising a substantial portion of said shaft;

said second shaft portion having a length;

said second shaft portion and said first shaft portion being joined at a middle portion of said shaft;

apparatus for mounting said shaft at least partially within the recess;

apparatus for changing the length of said first shaft portion independently of said second shaft portion;

said apparatus for changing the length of said first shaft portion independently of said second shaft portion comprising structure to axially move said middle shaft portion;

said structure to axially move said middle shaft portion comprising a device disposed at said middle shaft portion to axially move said middle shaft portion;

said apparatus for changing the length of said first shaft portion independently of said second shaft portion comprising a first actuation device to apply a force to said first shaft portion;

said retaining apparatus comprising a first retaining element;

said first retaining element being fixedly disposed on said shaft;

said first retaining element being disposed adjacent said middle shaft portion and said second shaft portion;

said device to axially move said middle shaft portion comprises a base to support a portion of said middle shaft portion;

said base being disposed at least partially within the recess;

said base being fastened to the plate cylinder; and said portion of said middle shaft portion being rotationally mounted within said base.

2. The device according to claim 1, wherein:

said shaft comprises a first end portion and a second end portion;

said first shaft portion comprises said first end portion of said shaft;

said second shaft portion comprises said second end portion of said shaft;

said apparatus for mounting said shaft at least partially within the recess is configured to mount each of said first and second end portions of said shaft;

said retaining apparatus comprises a second retaining element;

said second retaining element is fixedly attached to said shaft adjacent said middle shaft portion and said first shaft portion;

said base is disposed between said first and second retaining elements;

said first actuation device comprises a first adjustment device to permit an adjustment of the magnitude of a force applied to said first shaft portion;

said first adjustment device is operatively connected to said first end portion of said shaft;

said device to axially move said middle shaft portion comprises a first axial bearing;

said first axial bearing is disposed between said base and said first retaining element;

said first axial bearing is disposed about said shaft;

said first axial bearing is configured to guide said shaft in the longitudinal direction during axial movement of said middle shaft portion;

said first axial bearing is disposed to transfer a force between said first retaining element and said base during axial movement of said middle shaft portion;

said apparatus for changing the length further comprises apparatus for changing the length of said second shaft portion independently of a substantial portion of said first shaft portion;

said apparatus for changing the length of said second shaft portion independently of a substantial portion of said first shaft portion comprises a second actuation device to apply a force to said second shaft portion;

said second actuation device comprises a second adjustment device to permit an adjustment of the magnitude of a force applied to said second shaft portion;

said second adjustment device is operatively connected to said second end portion of said shaft;

said device to axially move said middle shaft portion comprises a second axial bearing;

said second axial bearing is disposed between said base and said second retaining element;

said second axial bearing is disposed about said shaft;

said second axial bearing is configured to guide said shaft in the longitudinal direction during axial movement of said middle shaft portion;

said second axial bearing is disposed to transfer a force between said second retaining element and said base during axial movement of said middle shaft portion;

said device to axially move said middle shaft portion further comprises a third adjustment device to permit an adjustment of the magnitude of a force applied to said middle shaft portion by said device to axially move said middle shaft portion;

said third adjustment device comprises a bushing;

said bushing is disposed in said base;

said shaft extends through said bushing;

said bushing is disposed to selectively transfer a force between said base and one of said first and second axial bearings during axial movement of said middle shaft portion;

said bushing is moveable along said shaft to vary a force applied to said one of said first and second axial bearings;

said bushing is threadingly mounted in said base to permit movement of said bushing along said shaft;

said third adjustment device comprises a screw to selectively eliminate clearance between said bushing and one of said first retaining element and said second retaining element;

said screw is mounted in said base; and said screw is moveable along said shaft to contact said bushing.

3. The device according to claim 1, wherein:

said shaft comprises a first end portion and a second end portion;

said first shaft portion comprises said first end portion of said shaft;

said second shaft portion comprises said second end portion of said shaft;

said apparatus for mounting said shaft at least partially within the recess is configured to mount each of said first and second end portions of said shaft;

said retaining apparatus comprises a second retaining element;

said second retaining element is fixedly attached to said shaft adjacent said middle shaft portion and said first shaft portion;

said base is disposed between said first and second retaining elements;

said first actuation device comprises a first adjustment device to permit an adjustment of the magnitude of a force applied to said first shaft portion;

said first adjustment device is operatively connected to said first end portion of said shaft;

said device to axially move said middle shaft portion comprises a first axial bearing;

said first axial bearing is disposed between said base and said first retaining element;

said first axial bearing is disposed about said shaft;

said first axial bearing is configured to guide said shaft in the longitudinal direction during axial movement of said middle shaft portion;

said first axial bearing is disposed to transfer a force between said first retaining element and said base during axial movement of said middle shaft portion;

said apparatus for changing the length further comprises apparatus for changing the length of said second shaft portion independently of a substantial portion of said first shaft portion;

said apparatus for changing the length of said second shaft portion independently of a substantial portion of said first shaft portion comprises a second actuation device to apply a force to said second shaft portion;

said second actuation device comprises a second adjustment device to permit an adjustment of the magnitude of a force applied to said second shaft portion;

said second adjustment device is operatively connected to said second end portion of said shaft;

said device to axially move said middle shaft portion comprises a second axial bearing;

said second axial bearing is disposed between said base and said second retaining element;

said second axial bearing is disposed about said shaft;

said second axial bearing is configured to guide said shaft in the longitudinal direction during axial movement of said middle shaft portion;

said second axial bearing is disposed to transfer a force between said second retaining element and said base during axial movement of said middle shaft portion;

said device to axially move said middle shaft portion further comprises a biasing device to return said middle shaft portion to the position of said middle shaft portion prior to the application of said first actuation device and to return said middle shaft portion to the position of said middle shaft portion prior to the application of said second actuation device;

said biasing device comprises a first spring and a second spring;

said first spring is disposed between said base and said first retaining element;

said first spring is configured to apply a force to return said middle shaft portion to the position of said middle shaft portion prior to the application of said first actuation device;

said second spring is disposed between said base and said second retaining element; and said second spring is configured to apply a force to return said middle shaft portion to the position of said middle shaft portion prior to the application of said second actuation device.

4. The device according to claim 1, wherein:

said shaft comprises a first end portion and a second end portion;

said first shaft portion comprises said first end portion of said shaft;

said second shaft portion comprises said second end portion of said shaft;

said apparatus for mounting said shaft at least partially within the recess is configured to mount each of said first and second end portions of said shaft;

said retaining apparatus comprises a second retaining element;

said second retaining element is fixedly attached to said shaft adjacent said middle shaft portion and said first shaft portion;

said base is disposed between said first and second retaining elements;

said first actuation device comprises a first adjustment device to permit an adjustment of the magnitude of a force applied to said first shaft portion;

said first adjustment device is operatively connected to said first end portion of said shaft;

said device to axially move said middle shaft portion comprises a first axial bearing;

said first axial bearing is disposed between said base and said first retaining element;

said first axial bearing is disposed about said shaft;

said first axial bearing is configured to guide said shaft in the longitudinal direction during axial movement of said middle shaft portion;

said first axial bearing is disposed to transfer a force between said first retaining element and said base during axial movement of said middle shaft portion;

said apparatus for changing the length further comprises apparatus for changing the length of said second shaft portion independently of a substantial portion of said first shaft portion;

said apparatus for changing the length of said second shaft portion independently of a substantial portion of said first shaft portion comprises a second actuation device to apply a force to said second shaft portion;

said second actuation device comprises a second adjustment device to permit an adjustment of the magnitude of a force applied to said second shaft portion;

said second adjustment device is operatively connected to said second end portion of said shaft;

said device to axially move said middle shaft portion comprises a second axial bearing;

said second axial bearing is disposed between said base and said second retaining element;

said second axial bearing is disposed about said shaft;

said second axial bearing is configured to guide said shaft in the longitudinal direction during axial movement of said middle shaft portion;

said second axial bearing is disposed to transfer a force between said second retaining element and said base during axial movement of said middle shaft portion;

said device to axially move said middle shaft portion further comprises a biasing device to return said middle shaft portion to the position of said middle shaft portion prior to the application of said first actuation device and to return said middle shaft portion to the position of said middle shaft portion prior to the application of said second actuation device;

said biasing device comprises a first portion of said base;

said first portion of said base comprises a first cross-section area;

said base comprises a second portion; and said second portion of said base comprises a second cross-section area greater than said first cross-section area.

5. A device for tensioning a printing plate on a plate cylinder of a rotary printing press, which plate cylinder has a first axial end, and a second axial end disposed opposite to said first axial end, which plate cylinder defines an axial axis between the first and second axial ends thereof, which plate cylinder has an axially disposed recess therein for at least partially accommodating said device, said device comprising:

retaining apparatus for retaining the end of a printing plate to a plate cylinder;

said retaining apparatus comprising a shaft for being at least partially disposed in the recess;

said shaft having a longitudinal axis;

said shaft comprising a first shaft portion and a second shaft portion;

said first shaft portion comprising a substantial portion of said shaft;

said first shaft portion having a length;

said second shaft portion comprising a substantial portion of said shaft;

said second shaft portion having a length;

said second shaft portion and said first shaft portion being joined at a middle portion of said shaft;

apparatus for mounting said shaft at least partially within the recess;

apparatus for changing the length of said first shaft portion independently of said second shaft portion;

said apparatus for changing the length of said first shaft portion independently of said second shaft portion comprising structure to axially move said middle shaft portion; and said structure to axially move said middle shaft portion comprising a device disposed at said middle shaft portion to axially move said middle shaft portion.

6. The device according to claim 5, wherein:

said first shaft portion has a first end portion and a second end portion;

said first end portion is disposed opposite said second end portion;

said second end portion is disposed adjacent said second shaft portion;

said apparatus for mounting said shaft at least partially within the recess comprises structure to mount said first end portion; said device to axially move said middle shaft portion comprises a support device to support a portion of said middle shaft portion;

said support device comprises a base;

said base is disposed at least partially within the recess;

said base is fastened to the plate cylinder; and said portion of said middle shaft portion is rotationally mounted within said base.

7. The device according to claim 6, wherein:

said retaining apparatus for retaining the end of a printing plate to a plate cylinder comprises a first retaining element;

said first retaining element is fixedly attached to said shaft adjacent said middle shaft portion and said second shaft portion;

said first retaining element is disposed adjacent to said base;

said apparatus for changing the length of said first shaft portion independently of said second shaft portion comprises a first actuation device to apply a force to said first shaft portion;

said first actuation device comprises a first adjustment device to permit a first adjustment of the magnitude of a force applied to said first shaft portion;

said first adjustment device is operatively connected to said first end portion of said first shaft portion; and said first retaining element is disposed to transfer a force between said middle shaft portion and said base during axial movement of said middle shaft portion.

8. The device according to claim 7, wherein:

said support device comprises structure to guide said shaft during axial movement of said middle shaft portion;

said structure to guide said shaft comprises a first axial bearing;

said first axial bearing is disposed between said base and said first retaining element;

said shaft extends through said first axial bearing;

said first axial bearing is configured to guide the shaft in a longitudinal direction substantially parallel to the longitudinal axis of said shaft during axial movement of said middle shaft portion; and said first axial bearing is disposed to transfer a force between said base and said first retaining element during axial movement of said middle shaft portion.

9. The device according to claim 8, wherein:

said device to axially move said middle shaft portion comprises a second adjustment device to permit an adjustment of the magnitude of a force applied to said middle shaft portion;

said second adjustment device comprises a bushing;

said bushing is mounted in said base;

said shaft extends through said bushing;

said bushing is disposed to transfer a force between said first axial bearing and said base during axial movement of said middle shaft portion;

said bushing is moveable along said shaft to vary a force applied to said middle shaft portion; and said bushing is threadingly mounted in said base to permit the movement of said bushing along said shaft.

10. The device according to claim 9, wherein:

said bushing comprises a first portion;

said first portion of said bushing is disposed between said base and said first axial bearing;

said second adjustment device comprises a device to eliminate clearance between said bushing and said first retaining element;

said device to eliminate clearance comprises a screw;

said screw is mounted in said base;

said screw is movable along said shaft to contact said first portion of said bushing; and said screw is threadingly mounted in said base to permit movement of said screw along said shaft.

11. The device according to claim 10, wherein:

said second shaft portion comprises a first end portion and a second end portion;

said second end portion of said second shaft portion is opposite said first end portion of said second shaft portion;

said first end portion of said second shaft portion is disposed adjacent said middle shaft portion;

said apparatus for mounting said shaft at least partially within the recess comprises structure to mount said second end portion of said second shaft portion;

said apparatus for changing the length further comprises apparatus for changing the length of said second shaft portion independently of a substantial portion of said first shaft portion;

said apparatus for changing the length of said second shaft portion independently of a substantial portion of said first shaft portion comprises a second actuation device to apply a force to said second shaft portion;

said second actuation device comprises a third adjustment device to permit adjustment of the magnitude of a force applied to said second shaft portion;

said third adjustment device is operatively connected to said second end portion of said second shaft portion;

said retaining apparatus comprises a second retaining element;

said second retaining element is fixedly attached to said shaft adjacent said middle shaft portion and said first shaft portion;

said base is disposed between said first and second retaining elements;

said second retaining element is disposed to transfer a force between said middle shaft portion and said base during axial movement of said middle shaft portion;

said structure to guide said shaft comprises a second axial bearing;

said shaft extends through said second axial bearing;

said second axial bearing is disposed between said second retaining element and said base;

said second axial bearing is disposed to transfer a force between said second retaining element and said base during axial movement of said middle shaft portion; and said second adjusting device is configured to permit an adjustment of the magnitude of a force applied to said middle shaft portion.

12. The device according to claim 8, wherein said device to axially move said middle shaft portion comprises a biasing device to return said middle shaft portion to the position of said middle shaft portion prior to the application of said first actuation device.

13. The device according to claim 12, wherein:

said biasing device comprises a first spring;

said first spring is disposed between said base and said first retaining element; and said first spring is configured to return said middle shaft portion to the position of said middle shaft portion prior to the application of said first actuation device.

14. The device according to claim 13, wherein:

said second shaft portion comprises a first end portion and a second end portion;

said second end portion of said second shaft portion is opposite said first end portion of said second shaft portion;

said first end portion of said second shaft portion is disposed adjacent said middle shaft portion;

said apparatus for mounting said shaft at least partially within the recess comprises structure to mount said second end portion of said second shaft portion;

said apparatus for changing the length further comprises apparatus for changing the length of said second shaft portion independently of a substantial portion of said first shaft portion;

said apparatus for changing the length of said second shaft portion independently of a substantial portion of said first shaft portion comprises a second actuation device to apply a force to said second shaft portion;

said second actuation device comprises a second adjustment device to permit adjustment of the magnitude of a force applied to said second shaft portion;

said second adjustment device is operatively connected to said second end portion of said second shaft portion;

said retaining apparatus comprises a second retaining element;

said second retaining element is fixedly attached to said shaft adjacent said middle shaft portion and said first shaft portion;

said base is disposed between said first and second retaining elements;

said second retaining element is disposed to transfer a force between said second shaft portion and said base during axial movement of said middle shaft portion;

said structure to guide said shaft comprises a second axial bearing;

said shaft extends through said second axial bearing;

said second axial bearing is disposed between said second retaining element and said base;

said second axial bearing is disposed to transfer a force between said second retaining element and said base during axial movement of said middle shaft portion;

said device to axially move said middle shaft portion comprises a second biasing device to return said middle shaft portion to the position of said middle shaft portion prior to the application of said second actuation device;

said second biasing device comprises a second spring;

said second spring is disposed between said base and said second retaining element; and said second spring is configured to return said middle shaft portion to the position of said middle shaft portion prior to the application of said second actuation device.

15. The device according to claim 12, wherein:

said biasing device comprises a first portion of said base;

said first base portion comprises a first cross-section area;

said base comprises a second portion; and said second base portion comprises a second cross-section area greater than said first cross-section area.

16. The device according to claim 15, wherein:

said second shaft portion comprises a first end portion and a second end portion;

said second end portion of said second shaft portion is opposite said first end portion of said second shaft portion;

said first end portion of said second shaft portion is disposed adjacent said middle shaft portion;

said apparatus for changing the length further comprises apparatus for changing the length of said second shaft portion independently of a substantial portion of said first shaft portion;

said apparatus for changing the length of said second shaft portion independently of a substantial portion of said first shaft portion comprises a second actuation device to apply a force to said second shaft portion;

said second actuation device comprises a second adjustment device to permit adjustment of the magnitude of the force applied to said second shaft portion;

said second adjustment device is operatively connected to said second end portion of said second shaft portion;

said retaining apparatus comprises a second retaining element;

said second retaining element is fixedly attached to said shaft adjacent said middle shaft portion and said first shaft portion;

said base is disposed between said first and second retaining elements;

said second retaining element is disposed to transfer a force between said middle shaft portion and said base during axial movement of said middle shaft portion;

said structure to guide said shaft comprises a second axial bearing;

said shaft extends through said second axial bearing;

said second axial bearing is disposed between said second retaining element and said base;

said second axial bearing is disposed to transfer a force between said second retaining element and said base during axial movement of said middle shaft portion; and said biasing device is configured to return said middle shaft portion to the position of said middle shaft portion prior to the application of said second actuation device.

17. A device for tensioning a printing plate on a plate cylinder of a rotary printing press, which plate cylinder has a first axial end, and a second axial end disposed opposite to said first axial end, which plate cylinder defines an axial axis between the first and second axial ends thereof, which plate cylinder has an axially disposed recess therein for at least partially accommodating said device, said device comprising:

retaining apparatus for retaining the end of a printing plate to a plate cylinder;

said retaining apparatus comprising a shaft for being at least partially disposed in the recess;

said shaft having a longitudinal axis;

said shaft comprising a first shaft portion and a second shaft portion;

said first shaft portion comprising a substantial portion of said shaft;

said first shaft portion having a length;

said second shaft portion comprising a substantial portion of said shaft;

said second shaft portion having a length;

said second shaft portion and said first shaft portion being joined at a middle portion of said shaft;

apparatus for mounting said shaft at least partially within said recess;

apparatus for changing the length of said first shaft portion independently of said second shaft portion and for changing the length of said second shaft portion independently of a substantial portion of said first shaft portion;

said apparatus for changing the length of said first shaft portion independently of said second shaft portion comprising structure to axially move said middle shaft portion; and said structure for axially moving said middle shaft portion comprising a device disposed at said middle shaft portion to axially move said middle shaft portion.

18. The device according to claim 17, wherein:

said shaft comprises a first end portion and a second end portion;

said first end portion of said shaft is opposite said second end portion of said shaft;

said first shaft portion comprises said first end portion of said shaft;

said second shaft portion comprises said second end portion of said shaft;

said apparatus for mounting said shaft at least partially within said recess comprises structure to mount both of said first and second end portions of said shaft;

said retaining apparatus comprises a first retaining element and a second retaining element;

each of said first and second retaining elements is fixedly connected to said shaft;

said first retaining element is disposed adjacent said middle shaft portion and said second shaft portion;

said second retaining element is disposed adjacent said middle shaft portion and said first shaft portion;

said apparatus for changing the length of said first shaft portion independently of said second shaft portion and for changing the length of said second shaft portion independently of a substantial portion of said first shaft portion comprises:

a first actuation device to apply a force to said first shaft portion;

a second actuating device to apply a force to said second shaft portion;

a first adjusting device to permit an adjustment of the magnitude of a force applied to said first shaft portion;

said first adjusting device is operatively connected to said first end portion of said shaft;

a second adjusting device to permit an adjustment of the magnitude of a force applied to said second shaft portion; and said second adjusting device is operatively connected to said second end portion of said shaft;

said device to axially move said middle shaft portion comprises:

a base;

said base is disposed between said first retaining element and said second retaining element;

said base is disposed about a portion of said middle shaft portion;

said portion of said middle shaft portion is rotationally mounted within said base;

a first axial bearing;

said first axial bearing is disposed about said shaft;

said first axial bearing is disposed between said first retaining element and said base;

said first axial bearing is configured to guide said shaft in the longitudinal direction during axial movement of said middle shaft portion;

a second axial bearing;

said second axial bearing is disposed about said shaft;

said second axial bearing is disposed between said second retaining element and said base; and said second axial bearing is configured to guide said shaft in the longitudinal direction during axial movement of said middle shaft portion.

19. The device according to claim 18, wherein:

said device to axially move said middle shaft portion comprises a third adjustment device;

said third adjustment device is configured to selectively vary a force applied by said device to axially move said middle shaft portion;

said third adjustment device comprises a bushing; and said third adjustment device comprises a screw.

20. The device according to claim 18, wherein:

said device to axially move said middle shaft portion comprises a biasing device;

said biasing device is configured to return said middle shaft portion to the position of said middle shaft portion prior to the application of said first actuation device and to return said middle shaft portion to the position of said middle shaft portion prior to the application of said second actuation device;

said base comprises a first portion;

said first portion of said base comprises a first cross-section area; and said biasing device comprises at least one of the following A) and B):

A) a second portion of said base;

said second portion of said base comprises a second cross-section area less than said first cross-section area of said first base portion; and B) a first spring;

said first spring is disposed between said base and said first retaining element;

said first spring is configured to return said middle shaft portion to the position of said middle shaft portion prior to the application of said first actuation device;

a second spring;

said second spring is disposed between said base and said second retaining element; and said second spring is configured to return said middle shaft portion to the position of said middle shaft portion prior to the application of said second actuation device.

* * * * *